US005884361A

United States Patent [19]

Richardson et al.

[11] Patent Number: 5,884,361

[45] Date of Patent: Mar. 23, 1999

[54] SLIDER DOOR MECHANISM, RUNNING GEAR MECHANISM AND CLOSURE RETURN

[75] Inventors: Richard J. Richardson, Simi Valley; Charles E. Crown, San Fernando, both of Calif.

[73] Assignee: Anthony's Manufacturing Company, San Fernando, Calif.

[21] Appl. No.: 835,587

[22] Filed: Apr. 9, 1997

Related U.S. Application Data

[63] Continuation of Ser. No. 318,622, filed as PCT/US93/02078, Mar. 8, 1993, published as WO93/18260, Sep. 16, 1993, abandoned.

[51] Int. Cl.[6] ..... A47H 15/00; A47H 1/04

[52] U.S. Cl. ..... 16/100; 16/90; 16/102; 16/106; 16/107; 16/96 R

[58] Field of Search ..... 16/90, 100, 101, 16/102, 106, 107, 94 R, 96 R, 96 D, 96 L, 87 R, 45, 93 D; 49/425, 410, 411

[56] References Cited

U.S. PATENT DOCUMENTS

| | | | |
|---|---|---|---|
| 36,647 | 10/1862 | Gilfillan . | |
| 172,887 | 2/1876 | Miller . | |
| 200,107 | 2/1878 | Threlfall . | |
| 350,535 | 10/1886 | Hicks . | |
| 400,041 | 3/1889 | Bender et al. . | |
| 809,695 | 1/1906 | Keil . | |
| 946,056 | 1/1910 | Knape . | |
| 1,010,071 | 11/1911 | Potter . | |
| 1,048,240 | 12/1912 | Voigt . | |
| 1,288,575 | 12/1918 | Harris . | |
| 1,426,452 | 8/1922 | Berman . | |
| 1,491,001 | 4/1924 | Cralley . | |
| 1,524,765 | 2/1925 | Arnhem . | |
| 1,624,306 | 4/1927 | Barrows . | |
| 1,755,880 | 4/1930 | Keil . | |
| 1,945,008 | 1/1934 | Voigt | 16/100 |
| 1,956,651 | 5/1934 | Moran . | |
| 2,003,577 | 6/1935 | Campbell et al. . | |
| 2,227,854 | 1/1941 | Walters . | |
| 2,374,490 | 4/1945 | Lehman | 49/425 |
| 2,495,877 | 1/1950 | Theilman | 49/425 |
| 2,527,740 | 10/1950 | Kurtzon . | |
| 2,594,058 | 4/1952 | Myhr . | |
| 2,643,162 | 6/1953 | Barr | 384/58 |
| 2,677,154 | 5/1954 | Agle | 16/100 |
| 3,033,285 | 5/1962 | Banner . | |
| 3,117,657 | 1/1964 | Bruno | 49/425 |
| 3,220,045 | 11/1965 | Teague et al. | 16/21 |
| 3,281,993 | 11/1966 | Riegelman . | |
| 3,397,487 | 8/1968 | Hunt et al. | 49/425 |
| 3,530,618 | 9/1970 | Grossman . | |
| 3,583,101 | 6/1971 | Pudenz . | |
| 3,800,472 | 4/1974 | Nagy . | |
| 3,837,119 | 9/1974 | Conneally et al. . | |
| 3,928,889 | 12/1975 | Wartian . | |
| 3,956,854 | 5/1976 | Yamamoto . | |
| 3,978,617 | 9/1976 | Eventoff . | |
| 3,996,643 | 12/1976 | Steigerwald | 16/99 |
| 4,064,592 | 12/1977 | Riegelman et al. . | |
| 4,301,623 | 11/1981 | Demukai . | |
| 4,404,771 | 9/1983 | Murase et al. . | |
| 4,611,436 | 9/1986 | Williams . | |
| 4,633,615 | 1/1987 | Moose | 16/100 |
| 4,639,970 | 2/1987 | Adams | 16/100 |
| 4,641,461 | 2/1987 | Niekrasz et al. . | |
| 4,656,781 | 4/1987 | Niekrasz et al. . | |
| 4,891,911 | 1/1990 | Yung . | |
| 5,148,630 | 9/1992 | Llorens | 49/425 |

*Primary Examiner*—Chuck Y. Mah
*Attorney, Agent, or Firm*—Henricks, Slavin & Holmes LLP

[57] ABSTRACT

A wheel unit is disclosed for supporting a structure for movement on a track. The unit includes a rotatable wheel having a substantially flat bearing surface and supported on an axis for running on a track. A housing supports the wheel and includes a convex-shaped guide for maintaining the wheel on the track. A wheel and track combination is also disclosed wherein the wheel has a contact surface having a first dimension and supported by the housing to rotate about an axis. The track supports the housing and wheel and includes a contact surface for contacting the contact surface of the wheel and wherein the contact surface of the track has a second dimension larger than the first dimension of the contact surface on the wheel. Preferably, a guide keeps the wheel on the track while permitting the wheel to move laterally on the track.

43 Claims, 9 Drawing Sheets

FIG. 1
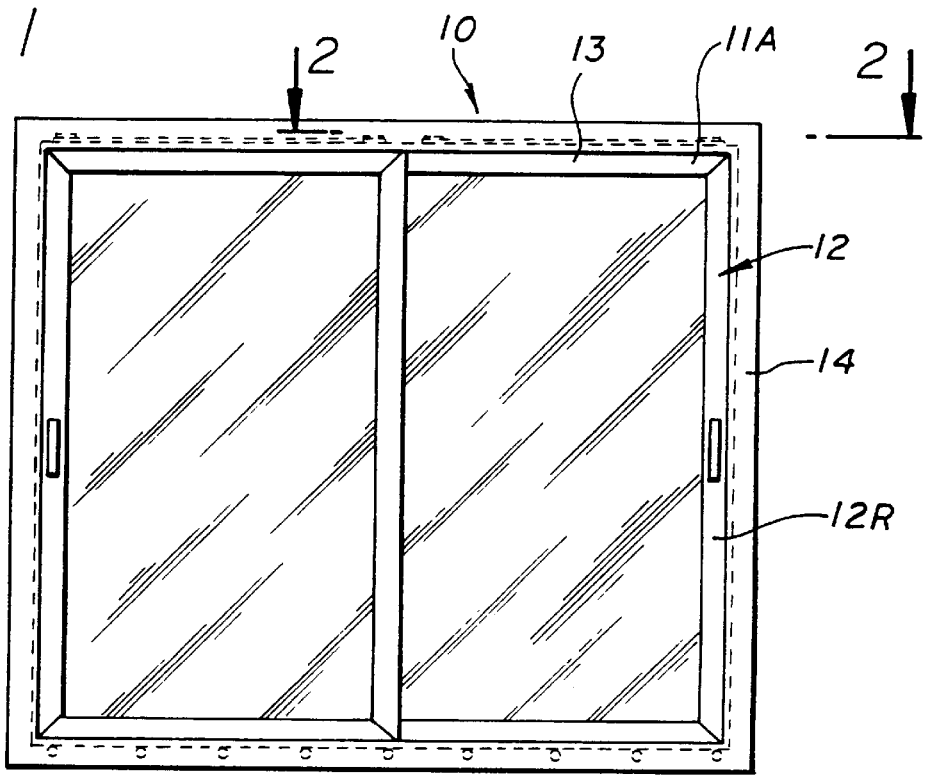
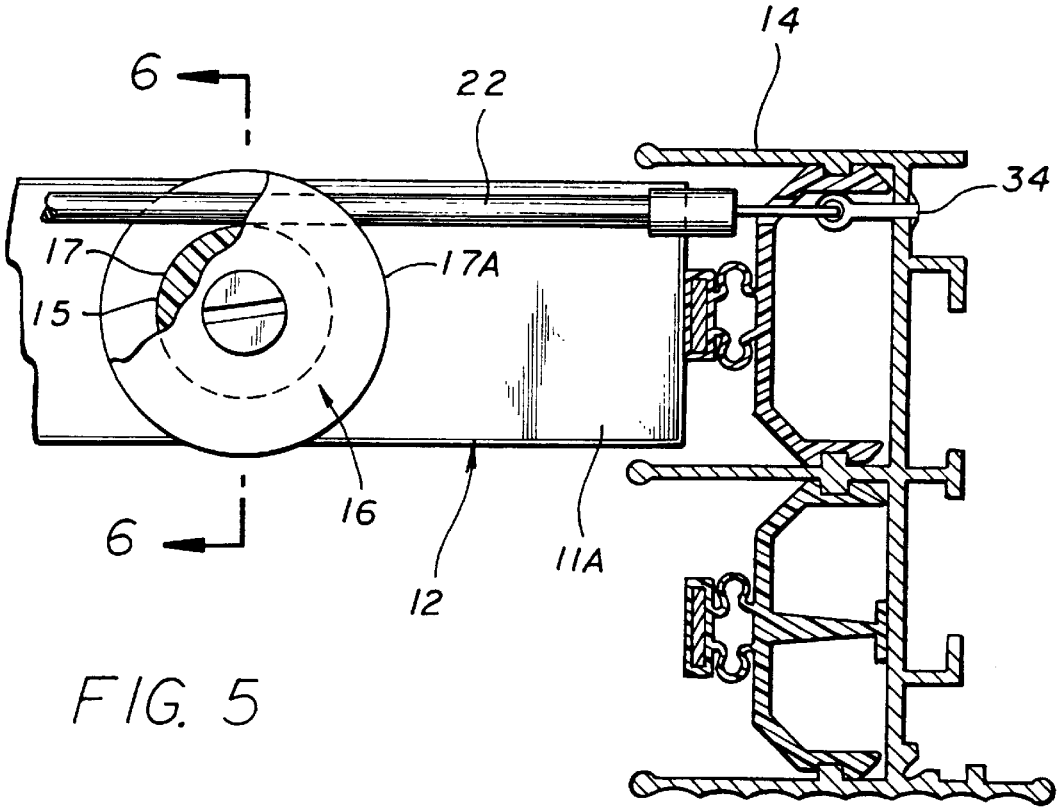
FIG. 5

SLIDER DOOR MECHANISM, RUNNING GEAR MECHANISM AND CLOSURE RETURN

This is a continuation of application Ser. No. 08/318,622, filed as PCT/US93/02078, Mar. 8, 1993, published as WO93/18260, Sep. 16, 1993, now abandoned.

BACKGROUND OF THE INVENTION

1. Field of the Invention

The present invention relates in general to closures and more particularly to a return mechanism for automatically returning a closure to a given position. The invention is applicable to closing doors, especially the return of sliding doors to a closed position. The present invention also relates to running gear, including running gear for sliding doors.

2. Related Art

Often a door or other closure may be left open unintentionally after use, such as a refrigerator door, or a door may be left closed unintentionally, such as a door over a ventilator opening. It may be costly or undesirable for many types of closures to remain open after use, and it is, therefore, desirable to provide a mechanism for automatically closing the opened door or opening the closed door. Such closures include sliding doors as in a patio door or a commercial refrigerator door, hatches, stereo cabinets, swing doors, sash windows, or any closure movable from either an open position to a closed position or vice versa.

One type of closure for which a self return mechanism is particularly desirable is a sliding door often used for commercial refrigerators and refrigerated display cases. Commercial refrigerators and refrigerated display cases are employed in markets, food-vending operations and the like for the simultaneous preservation of freshness and attractive display of foodstuffs to the customer. Typically, commercial display cases have surrounding frames around an opening in a display case with tracks for supporting and guiding large sliding doors which incorporate large areas of multiple layered glazing to permit the customer to see, select and access the refrigerated product easily, while preventing what is termed a heat loss into the refrigerated space, namely letting warm air into the refrigerated section.

The customer may view the foodstuff in the refrigerator which they wish to purchase, open the sliding door to the refrigerated area, and remove the foodstuff for purchase. Occasionally, the customer may forget to close the sliding door to the refrigerated area. When the sliding door is left open, large amounts of heat are let into the refrigerated section, possibly leading to the spoilage of the foodstuffs while reducing the efficiency of the refrigerator and wasting valuable energy in maintaining the coolness of the refrigerated section. Often, a refrigerated section door that is not closed may remain open for a relatively long period of time if business is slow and employees of the store do not see the opened door.

In the case of sliding glass doors for display cases, for example those for refrigeration units, sometimes the doors will be designed to run slanted relative to the surrounding frame. In such situations, more surfaces of the door come into contact with the surrounding frame, or the wheel units produce greater frictional drag because a more uniform or constant frictional contact is necessary to maintain lateral alignment of the door. Where the running gear are grooved wheels, for example, where the grooved wheels maintain lateral alignment, greater frictional drag is created with a slanted door to maintain the slanted door in alignment.

Where the running gear provide lateral alignment, the running gear take the load and wear and tear, and therefore must be stronger or more rugged to withstand the increased wear.

Assemblies for automatically closing a sliding door are well-known in the art. However, automatically returnable sliding doors have design characteristics that can be improved. For instance, conventional sliding door return assemblies return the door at a relatively constant acceleration causing the door to slam shut and possibly not close completely because of bounce back. Further, if the door is opened only partially, the return force developed in the return assembly may not be sufficient to return the door to its fully closed position. The sliding door return assemblies further may be so complex that the sliding door is difficult to remove from its frame structure for service, which makes cleaning of the space between the door and the door frame structure more difficult. In commercial refrigerators and refrigerated display cases, this space must be cleaned on a regular basis to provide an efficient and sanitary unit as well as a clean appearance for customers and inspectors.

Typical sliding door and window units run with grooved wheels on round-topped rails. Depending on the construction, such running gear arrangements may operate sufficiently well for a given operation but may be inefficient in many other applications. For example, the doors may run rough or inefficiently using a grooved wheel-rail arrangement because the grooved wheel has surfaces which continually frictionally engage the rail. As the wheel rotates, the sides of the grooved wheel rub along the rail surface, producing drag. The wheel inherently serves a dual function, by supporting the weight of the door on top of the track and by maintaining transverse or lateral alignment as the sides of the grooved wheel engage the sides of the rail. These areas of contact produce frictional drag throughout the movement of the door.

The amount of frictional drag depends on the particular configuration of the running gear and the door. For example, in a grooved wheel and track configuration, a pair of grooved wheels placed longitudinally close together to run on the same track work against each other where there are curves, bends or other defects in the track. As one wheel follows a bend, the other adjacent wheel tries to remain aligned with the straight portion of the track. As a result, the side of the one wheel engaging the track urges the door in the direction of the bend, while the side of the other wheel contacting the track tries to keep the door aligned with the rest of the track. These counter forces not only create drag but cause the door to move unevenly and result in premature and undue wear in the running gear or track.

Frictional drag adversely affects not only smooth movement of the door, but also the operation of any self-return mechanism or other apparatus which relies on smooth operation of the door. With greater frictional drag in the running gear, for example, the self-return mechanism must be made stronger for proper functioning to overcome the increased frictional drag caused by the running gear. A stronger self-return mechanism necessarily shifts the range of operation of the self-return mechanism. A strong self-return mechanism means that the door might not be used in situations where only a more efficient or smooth running door would be used because a strong return may cause damage or limit the uses for the door. For example, a stronger self-return mechanism may cause a door to slam shut, and may preclude complete closing of a sliding glass door, for example, and also may cause injury to the user because of more force being created during the closing.

The quality of the running gear also affects the lifetime of the door or other structure as a whole. For example in door applications, many running gear units are rivetted or otherwise non-removably fastened to the bottom of the door. Therefore, if the running gear fails, the entire door must be replaced. Consequently, the life time and durability of the running gear typically determines the useful life of the entire door structure.

In order to incorporate a running gear into a sliding display door, for example, where the viewing area is important, the clearance of the door for installation and the appearance of the door after it is installed is important. For example, as the door is lifted into the frame to be installed, there must be sufficient clearance for the bottom of the door to get over the bottom of the frame and fall down into the frame. Thereafter, the door should appear symmetric in its surrounding frame so that the glass area in the door is centered in the frame for example and so that any trim is uniform around the surrounding frame. The wheel or other supporting structure under the door should not be so large that the door sits too high in the surrounding frame, but larger wheel units are preferable for smooth running and adequate support of the weight of the door. Additionally, the surrounding frame should not be too small on the bottom, for allowing the door to be placed into the frame, because the lower frame line would then expose more of the door structure, and maybe even show some of the running gear.

One aspect of running gear that is important to structures such as sliding glass doors is the size of the running gear. As the size is significant to sliding glass doors, this discussion with respect to the size of the running gear will be made in the context of sliding glass doors. Typically, the size of the surrounding frame is determined by the size of the opening such as for a refrigeration unit, case or opening which is filled by the sliding glass doors. Furthermore, the aesthetic appearance of the doors is quite often important, and it is often difficult to ensure symmetry of the door appearance around all four sides of the surrounding frame. For example, the top of the surrounding frame often extends downwardly more than the bottom of the surrounding frame extends upwardly, so that door installation is made easier when inserting the top of the door into the top of the frame and then pushing the bottom of the door over the bottom surrounding frame with sufficient clearance. The sliding glass door is then dropped into the bottom of the frame while the top of the door is still guided by and retained in the top frame. If the running gear is vertically too large, the top of the frame often must be higher, if the opening allows, so that the top of the door can extend farther into the top of the frame before the door clears the bottom of the frame; or the bottom of the frame must be made smaller so as to allow the door to clear the frame. As a result, sometimes the running gear on the bottom of the door shows above the bottom of the surrounding frame, or more of the bottom rail of the door is visible than the top rail of the door. Therefore, the design of the running gear including its size is quite significant.

Another aspect of the size of the running gear is significant in sliding glass doors, for example. In situations where the sliding glass doors are intended to operate on a slant, such as for some refrigeration units, oversized running gear shifts the doors upward relative to the surrounding frame. If the doors ride too high with the running gear relative to the surround frame, the bottom door rail may not contact the frame wall. Contact by the bottom door rail with the surrounding bottom frame is often necessary or desirable in order to provide support for the bottom of the door as the door moves in the frame. Changes would then be necessary to the surrounding frame to accommodate the sliding doors having oversized or overly large running gear.

The track configuration is also often significant in the operation and integrity of running gear and the structures they support. For example, tracks which are embedded or integral with the frame structure supporting them often suffer from the same defects or design problems inherent in or built into the supporting frame. For example, in the context of sliding glass doors, an embedded track would be as crooked or bumpy as the frame where, for example, the cabinet face in which the frame is set is not flush or straight, where the cabinet face is twisted or the surrounding frame is twisted, bent or where the opening in the cabinet is badly cut or formed. In the context of refrigeration cases, occasionally the so-called net opening is cut poorly. The installed surrounding frame then adopts the shape or form of the net opening, and an embedded track also takes on the defective shape. Other problems may arise such as where the frame is improperly installed.

Accordingly, one principal object of the present invention is to provide a self return mechanism for a closure which controls the return of the closure from a first position to a second position.

A further object of the present invention is to provide a door return which varies the acceleration and deceleration or rate of return of the door as it is automatically closed, to prevent the door from slamming into the door frame and not closing fully, to fully close the door regardless of how far the door has been opened, and to improve the safety of the door.

Another object of the present invention is to provide a self return mechanism where the rate of return of the door is subtly controlled by the use of a closing mechanism which provides a force capable of decreasing the rate of return of the door when it is automatically closed from its opened position without slamming the door into the door frame and which provides a force sufficient to close the door even when it is opened only partially.

A further object of the present invention is to provide a self return mechanism using varying frictional interaction between a portion of an elastic element and a braking element through which the elastic element passes to vary the rate of return of the door. This interaction could occur, for example, between a latex cord or tube elastic element and a grooved wheel whereby stretching and relaxing of the elastic element varies the frictional interaction between the elastic element and the wheel.

Another object of the present invention is to provide a slider door return system which allows for easy removal and replacement of the door from the door frame structure.

It is yet another object of the present invention to provide a slider door return system which is inexpensive to manufacture and simple to assemble.

It is yet a further object of one embodiment of the present invention to provide a slider door return system having the objects stated above for slanted sliding doors.

It is another object of the present invention to provide a wheel unit which minimizes the frictional engagement between the wheel and a track on which the wheel rides.

It is a further object of the present invention to provide a wheel and track unit which minimizes the surface contact between the wheel and a supporting rail to maintain the wheel on the track.

It is a further object of the present invention to provide a running gear unit for doors, closures and other moving structures which can be easily replaced on the structure, if the running gear fails unexpectedly, without having to replace the entire structure.

It is a further object of the present invention to provide a running gear mechanism which has a relatively low vertical profile, and which permits a larger viewing area for a door such as a sliding refrigerator door which is supported by the running gear.

It is another object of the present invention to provide a running gear mechanism which is simpler and easier to manufacture and assemble relative to previous running gear units.

It is a further object of the present invention to provide a wheel unit for supporting and transporting a structure wherein the wheel unit is self-aligning.

It is an additional object of the present invention to provide a wheel and track unit for supporting a structure for movement on the track which uses a track guide separate from the wheel riding on the track.

It is an additional object of the present invention to provide a wheel unit which provides smoother and more reliable operation for the supported structure.

It is a further object of the present invention to provide a wheel unit which can be easily cleaned to ensure sanitary conditions, such as those which may be required by statute or regulation.

It is a still further object of the present invention to provide a free floating track for supporting the wheel units and supported structures which may be self-aligning and which may be free to move as the structure travels over the track.

It is a further object of the present invention to provide a free floating track which is not subject to the design characteristics of the frame which supports the track.

These and other objects are provided in accordance with the present invention described herein.

SUMMARY OF THE INVENTION

In accordance with the present invention, a self return mechanism is provided which controls the acceleration and deceleration of a closure as it is automatically returned to a starting position, is capable of fully returning a closure when it is only partially moved from the starting position, is easy to remove and replace from its support structure, and is inexpensive and easy to assemble. The foregoing objectives are achieved through a movable closure having a fixed element defining a passageway, the fixed-element preferably being mounted to the closure, and a closure return element. The closure return element has an intermediate segment oriented to pass through the passageway of the fixed element. Preferably, the intermediate segment has an outside dimension that changes as the closure moves from a first position to a second position.

In one preferred embodiment of a self return mechanism for a closure, a sliding door is provided which is movable from an opened position to a closed position within a door frame structure. The sliding door may be vertical or slanted with respect to a vertical plane. A rotatable braking wheel is mounted close to the right hand corner, on a right hand door, on the top horizontal rail of the door. The braking wheel has a grooved circumference. An elastic element is releasably coupled to the door frame and to the top rail of the door so that it horizontally engages the grooved circumference of the braking wheel. The elastic element has an outer dimension that decreases as the elastic element is stretched and that increases as the elastic element is relaxed. The elastic element may be a hollow tubing or a solid cord and preferably may be made of latex or any material that has good memory with similar frictional characteristics to those of latex. The elastic element preferably is not sensitive to temperature extremes.

In a further preferred embodiment, a second rotatable pulley wheel is preferably mounted close to the left hand corner, on a right hand door, on the top horizontal rail of the door. The pulley wheel also has a grooved circumference. The elastic element frictionally engages the pulley wheel around the grooved circumference of the pulley wheel. The pulley wheel allows the elastic element to double back on itself so that the elastic element extends from the door frame through the grooved circumference of the braking wheel, and around the grooved circumference of the pulley wheel to an adjustment block mounted to the top horizontal rail of the door. The adjustment block has a plurality of coupling areas for coupling the end of the elastic element at different points to vary the length of the elastic element that is doubled back on itself.

By doubling back on itself, the elastic element can stretch over approximately one full width of the door, around the pulley, and then can preferably stretch back over approximately ninety percent of the width of the door. The doubling back of the elastic element provides twice the acceleration and deceleration force from the elastic element so that the elastic element can close the door even when it is opened only partially, i.e. one inch or less. Further, the doubling of the acceleration and deceleration by doubling back the elastic element on itself allows for optimum use of the elastic characteristics of the element and for more leeway in selection of other parameters such as the strength of the elastic element.

When the door is released from its opened position, the elastic element tends to relax, thus forcing the door to the closed position. The acceleration and deceleration of the door is controlled as it moves to its closed position due to the outer dimension of the elastic element increasing, thereby increasing the frictional surface area of contact of the elastic element with the grooved circumference of the braking wheel. The doubling back of the elastic element around the pulley wheel provides significant tension in the elastic element even when the door is closed so that the tension is sufficient to force the door to its closed position even when the door is opened only slightly. The controlled acceleration and deceleration of the closing door allows it to automatically close without the door slamming against the frame or leaving it slightly open.

In another preferred embodiment, a slanted sliding door is provided. When the sliding door is slanted, the outer circumference of the pulley wheel will preferably contact the door frame structure. In this embodiment, the elastic element preferably crosses over itself before engaging the grooved circumference of the pulley wheel and passes around the pulley wheel, thereby causing the pulley wheel to rotate in a direction opposite the rotation that otherwise would have been caused by the movement of the door when moving to its closed position. Friction is thereby created between the pulley wheel and the door frame structure causing further deceleration of the door as the tension in the elastic element forces the door to its closed position.

The present self return mechanism uses varying frictional interaction between a portion of an elastic element and a braking element through which the elastic element passes to vary the rate of return of the door. This configuration of the self return mechanism allows for easy removal and replacement of the door from the door frame structure by disconnecting the elastic element from the door frame structure and is inexpensive and simple to manufacture.

In accordance with another aspect of the present invention, a wheel unit is provided for supporting a structure for movement on a track wherein the wheel unit has a relatively pointed or V-shaped wheel bearing surface for running on the track. A housing supports the wheel and a guide maintains the wheel in alignment during movement, such as on the track. In one preferred embodiment, the guide is separate from the wheel. In another preferred embodiment, the guide includes spaced apart protrusions on the inside opposed surfaces of the housing such that the spacing between the protrusions is less than the maximum width of the track, such as where the track has an enlarged top on a rail and the housing "clicks" over the rail when the door is properly installed. This wheel unit provides a smoother running wheel structure, and when used with a closure such as a sliding glass door, it provides a door structure which is smoother running with minimal drag and one which may be used without any additional support for the door such as through wheels at the top of the door. When the wheel unit is used with sliding glass doors, the doors run easier, do not bind or drag as much as the wheel units of previous doors and typically last longer. Preferably, the wheel has a contact surface with a first contour, and the track supporting the housing and the wheel has a contact surface for contacting the contact surface of the wheel and wherein the contact surface on the track has a second contour different from the first contour.

In a preferred form of the invention, the guide is an inwardly extending protrusion, such as may be formed by spaced apart beads on opposite sides of the housing. The beads serve to guide the wheel and housing on the track by contacting the track when the wheel and housing move laterally relative to the track. Preferably, the surface area of contact of the beads is a minimum to minimize the frictional drag created between the beads and the track. Where the track includes an enlarged bead on top of a rail, the spacing between the beads or bumps on the housing may be less than the diameter of the bead on the rail so that the housing clicks over the rail when the wheel unit is being placed on the track.

In a preferred form of the wheel structure, the wheels are formed from a plastic with an internal bearing unit. The bearings are preferably supported by a suitable spindle which can be snapped into and out of the housing for replacement if the wheel unit unexpectedly fails. Replacement of the wheel units prolongs the lifetime of the door or other structure.

In accordance with a further aspect of the present invention, the wheel unit is fitted on closures such as sliding glass doors which are intended to operated in a slanted configuration. The wheel units move easily over the track with a minimum of frictional drag. Preferably, the wheels in the wheel assemblies are flat and have no side walls to contact the rail.

In a further preferred form of the invention, the track is formed as a metallic track insert placed in a groove in a door frame or other structure such that the track remains aligned regardless of defects, shifting or movement in the frame structure. For example, the track may be a metal track placed in a plastic groove in the outer frame surrounding one or more sliding glass doors. Quite often, the plastic groove will shift or change as a result of cold flowing. The metal track remains unaffected by such cold flowing since the track simply rests loosely in the plastic groove. Significantly, the track can remain aligned with the door structure, including the wheel units, even if the outer frame structure shifts or moves out of alignment. The separate track permits continued smooth running of the running gear on the track regardless of changes in the outer frame structure. The independent track decreases the possibility of creation of drag between the wheel units and the rail, thereby prolonging the lifetime of the wheel units, and therefore any door structure.

Other objects, features, and advantages of the invention will become apparent from a consideration of the following detailed description and from the accompanying drawings.

BRIEF DESCRIPTION OF THE DRAWINGS

FIG. 1 is a front elevation view of sliding doors which represent one application with which the present invention can be used.

FIG. 5 is an enlarged cross sectional view of the section identified by the circle 5 in FIG. 2 showing the door in its closed position.

DETAILED DESCRIPTION OF THE PREFERRED EMBODIMENTS

Figure 2:
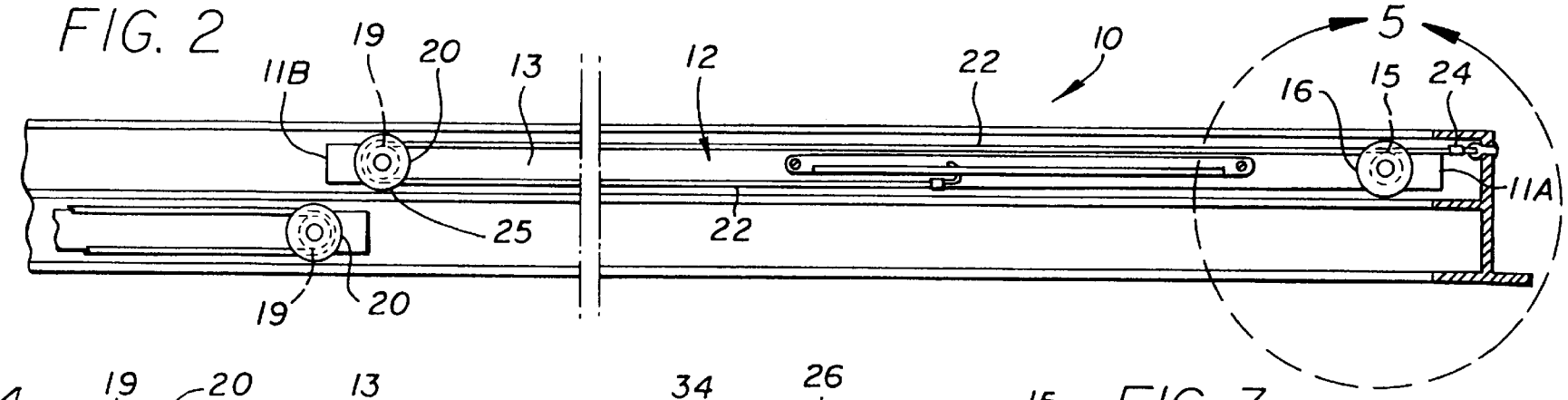
FIG. 2 is a top plan view and partial cross section taken along the line 2—2 in FIG. 1 showing a door return according to the present invention and showing the sliding doors in their closed position.

One aspect of the present invention is embodied in a self return mechanism that controls the acceleration and deceleration of a closure such as a door as it is automatically returned to a starting position, that can return a sliding door, for example, to its fully closed position when it is opened only partially, that allows for easy removal and replacement of the door from the door frame structure and that is inexpensive to manufacture and simple to assemble. The self return mechanism is suited for any type of closure such as sliding doors for patios, hatches, swing doors, stereo cabinets, sash windows, or any enclosure adapted for counterbalance systems where the closure is moved from a closed position to an opened position or from an opened position to a closed position.

In the particular embodiment shown in the drawings and herein described, the self return mechanism 10 (see FIGS. 1 and 2) is particularly suited for a movable closure or slider door 12 supported during movement by a stationary support structure such as a surrounding door frame structure 14. The door frame structure 14 is set in a case (defined by a "net opening") forming part of the refrigerated section of a supermarket or the like. The door frame structure 14 is of a size to support a pair of doors which are situated in a pair of tracks (FIG. 10), side-by-side, for allowing movement of both doors, as is well known to those skilled in the art. The doors are preferably any glass door for refrigeration applications. Representative dimensions of several sliding doors include 30 inches by 63 inches for what will be termed herein for purposes of identification only as a small-sized door, to 63 inches by 60 inches for a medium-sized door and 72 inches by 36 inches for a large-sized door. These dimensions may be larger or smaller depending on the application and the net opening, for example.

Figure 3:
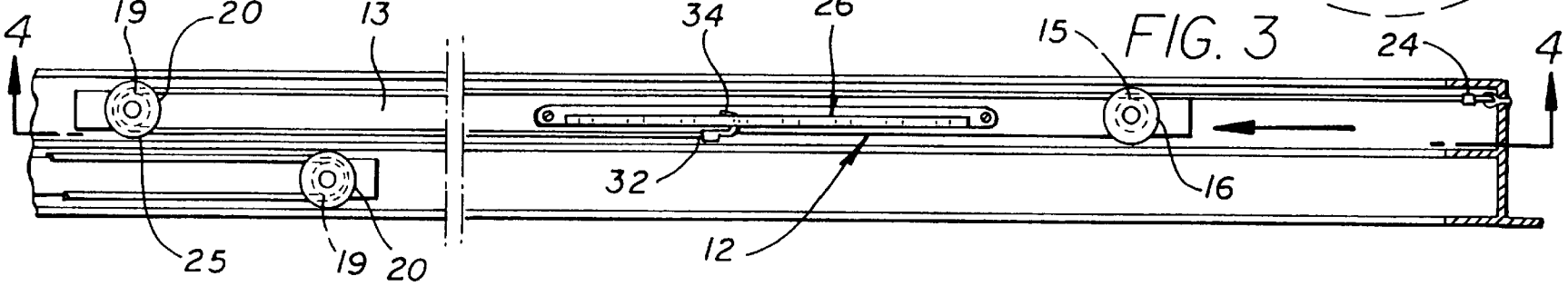
FIG. 3 is a top plan and partial cross sectional view similar to FIG. 2 showing the sliding door in an open position.
Figure 4:
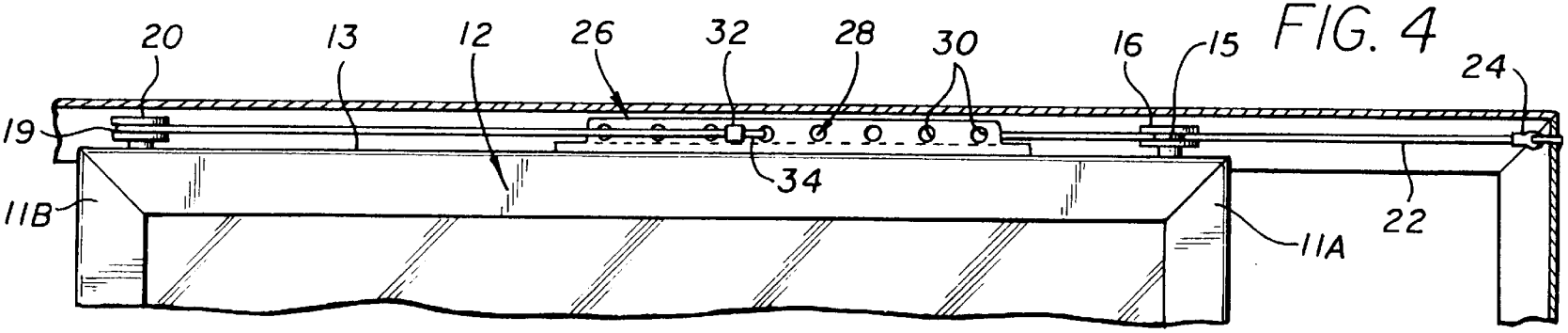
FIG. 4 is a front plan and partial cross sectional view taken along the line 4—4 in FIG. 3 showing the sliding door in an open position.
Figure 2A:
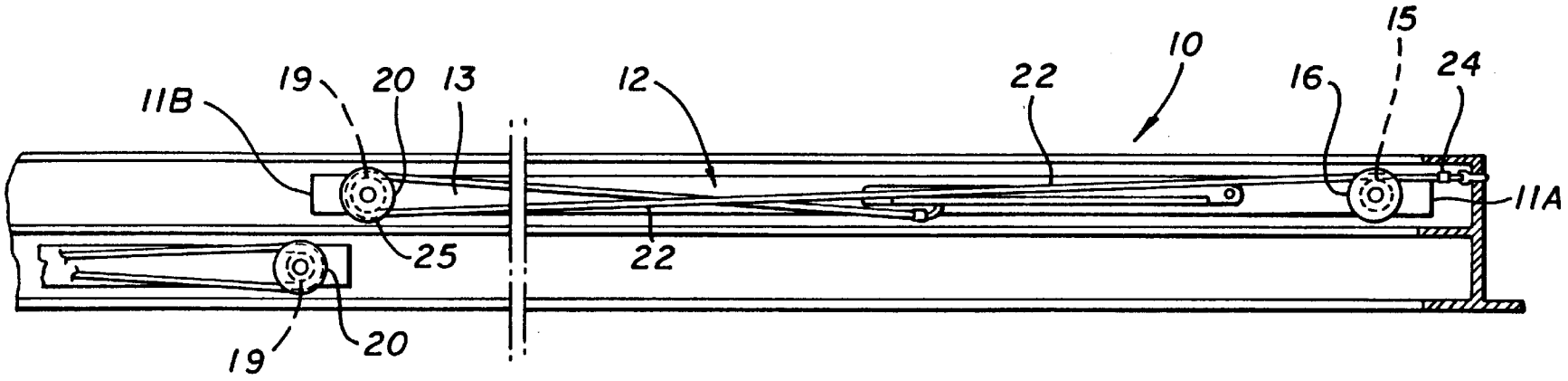
FIG. 2A is a top plan view and partial cross-section similar to FIG. 2 showing a door return having a cross over configuration.
Figure 6A:
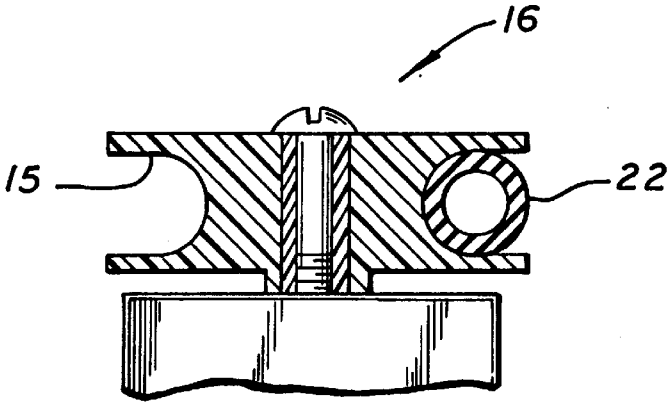
FIG. 6A is a transverse cross-sectional view similar to that of FIG. 6 showing a hollow elastic element engaged in the braking wheel.
Figure 6:
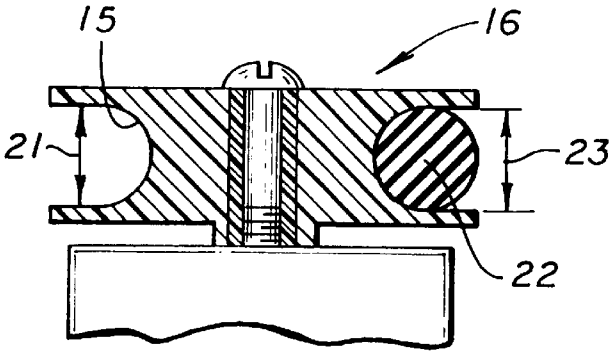
FIG. 6 is a transverse cross sectional view taken along the line 6—6 in FIG. 5 showing the elastic element engaged in the braking wheel.

The self return mechanism 10 has a fixed element preferably mounted on the door to define a restriction forming part of the apparatus for controlling the return of the door. The fixed element is preferably in the form of a braking wheel 16 freely rotatable about a spindle close to the right hand corner 11A on a right hand door 12R on the top horizontal rail 13 of the door. (FIGS. 2, 3, and 4). In this embodiment where the fixed element is in the form of a braking wheel, the restriction in the braking wheel is formed by a passageway defined by a grooved circumference 15 having a first diameter 17 and an outer circumference 17A having a second diameter greater than the first defining the depth of the groove (FIG. 5). The wheel 16 is termed a braking wheel as it serves to decelerate the door as it is pulled to the closed position by an elastic element 22. The braking wheel 16 is preferably constructed of a high density plastic with a bearing in its center such as a ball bearing or bearing sleeve. The plastic may be nylon or a similar material. The groove 15 of the braking wheel 16 has a semi-circular shape in transverse cross section (FIG. 6), and may have a diameter or gap 21 of preferably 5/32 inch for the small-sized door, 3/16 inch for the medium-sized door, and 1/4 inch for the large-sized door referenced above. The second or outside diameter of the drive wheel is preferably 29/32 inch for the small-sized door, 31/32 inch for the medium-sized door, and 1 and 9/16 inch for the large-sized door. These dimensions may be larger or smaller depending on the application.

A pulley wheel 20 is also preferably mounted to the left hand corner 11B on a right hand door 12R on the top horizontal rail 13 of the door 12. The pulley wheel 20 also has a grooved circumference 19. The size of the pulley wheel 20 is preferably identical to that of the braking wheel for each size of door 12. (FIGS. 2, 3, 4 and 5).

The self return mechanism 10 further includes a closure return element or elastic element 22 for moving the door from a first position, such as the open position in a refrigerator door, to a second position, such as the closed position, and for engaging the grooved circumference in the braking wheel, such that a dimension of the elastic element changes as the door moves from the open position to the closed position. As will be discussed below, the change in the dimension of the elastic element co-acts with the grooved circumference of the braking wheel to control the movement of the door. The elastic element has a fixed end 24 releasably coupled to the door frame structure 14 to anchor the elastic element preferably at the same vertical level as the pulley and braking wheels. The elastic element 22 is oriented to pass through the grooved circumference 15 of the braking wheel 16 and around the grooved circumference 19 of the pulley wheel 20 to double back on itself to provide the return force necessary to close the door when the door is released from any open position, whether fully or only partially open. The elastic element 22 is preferably doubled back on itself to provide a greater length in the element, and, likewise, to give a greater range of tension settings using the adjustment block 26. By doubling back the elastic element, or otherwise effectively adding more elastic material without changing the spring constant of the elastic element, the return force on the door can be adjusted or varied over a more defined range. The force on the door using a doubled back elastic element can be effectively increased without changing the spring constant of the material. Moreover, because the range of movement of the door is limited, the full elastic stretch of the elastic element is not used. Doubling back of the elastic element permits greater use of the stretch capabilities of the element. The other fixed end of the elastic element is releasably coupled to an adjustment block 26 so that the tension under which the elastic element is placed can be adjusted to suit the circumstances. (FIGS. 2, 3 and 4).

The elastic element 22 preferably extends over approximately the entire width of the door 12 and then doubles back around the pulley wheel 20 over approximately ninety percent of the width of the door 12. By doubling the elastic element 22 back on itself, the amount of force on the door from the elastic element can be doubled from the amount of force in an embodiment where the elastic element 22 does not double back on itself. (While FIG. 4 shows the elastic element doubling back an amount less than 90%, this is done for purposes of clarity to show the adjustment block, described more fully below.)

Figure 7:
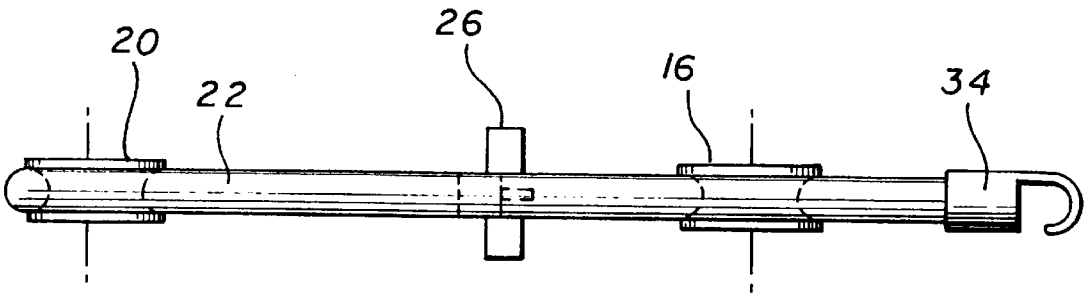
FIG. 7 is a schematic and side elevation view of the door return according to the present invention in a relaxed condition.
Figure 8:
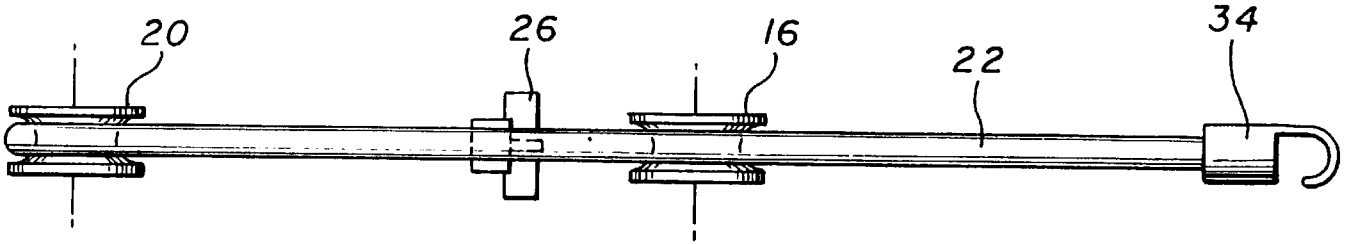
FIG. 8 is a schematic and side elevation view of a door return in a stretched or stressed condition, such as where a door is in a half-open position.
Figure 9:
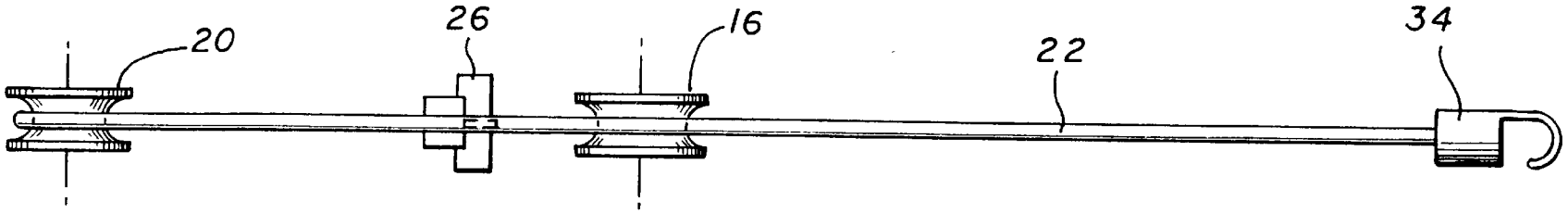
FIG. 9 is a schematic and side elevation view of a door return mechanism similar to FIGS. 7 and 8 showing the door return in a further stretched condition, such as when a door is in a full open position.

The elastic element 22 has an outer dimension 23 that decreases as the elastic element is stretched (see FIGS. 7–9) and that increases as the elastic element is relaxed. The elastic element 22 may be made of a hollow tubing or a solid cord and may be made of latex or any other elastic material, and preferably a material that can decrease its outer dimension 23 as it is stretched and increase its outer dimension 23 as it is relaxed from the stretched condition. The elastic element 22 may be any material that has good memory for example with similar frictional characteristics to those of latex and, in the preferred embodiment is not sensitive to temperature extremes. The use of an elastic element of this type eliminates the need to use a metallic spring, which may tend to bend unelastically when engaged around the grooved circumference of the pulley wheel and which does not have good frictional characteristics. The outer dimension 23 of the relaxed elastic element 22 (FIG. 7) is preferably equal to the diameter 21 or gap dimension of the grooved circumference 15 of the braking wheel 16 when the elastic element is properly tensioned with the door closed. The length of the relaxed elastic element 22 is proportional to the weight of the sliding door 12.

The self-return mechanism is capable of controlling the door's rate of return to its closed position by varying the frictional interaction between a portion of the elastic element 22 and the grooved circumference 15 of the braking wheel 16. This frictional interaction is obtained by the frictional engagement of that portion of the elastic element engaging the braking wheel with the grooved circumference of the braking wheel 16. Thus, as the door 12 is moved to its opened position, the elastic element 22 is stretched, causing its outer dimension 23 to decrease, thus decreasing the frictional surface area of contact of the elastic element 22 with the grooved circumference 15 of the braking wheel 16 and thereby decreasing the force necessary to move the door 12 to its open position against the tension of the elastic element below that which would be necessary without the frictional engagement.

When the door 12 is released from its opened position, the elastic element 22 tends to relax, providing sufficient tension to force the door to its closed position. The acceleration and deceleration of the door 12 is controlled as it moves to its closed position due to the increase in the outer dimension 23 of the elastic element 22, thereby increasing the frictional surface area of contact of the elastic element with the grooved circumference 15 of the braking wheel 16. In this manner, the changing dimension of the elastic element co-acts with the restriction formed by the dimensions of the grooved wheel to control the return of the door. The wall of the track in which the door travels prevents the elastic element from leaving the groove if the elastic tends to migrate out of the groove.

The adjustment block 26 is preferably mounted to the top horizontal rail 13 of the door 12 between the drive wheel 16 and the wheel 20. The adjustment block 26 may have a plurality of coupling areas 28 such as holes 30 for releasably coupling the fixed end 32 of the elastic element to the adjustment block to vary the amount of tension in the elastic element 22. The elastic element 22 has coupling means such as a hook fixed to each end 24 and 32 for coupling the elastic element to the coupling areas formed into the adjustment block 26 and an eyelet socket 34 mounted to the door frame structure 14 for coupling to the door frame structure. (FIGS. 2, 3, 4 and 5). This configuration for coupling the ends of the elastic element also provides for easy removal and assembly of the door for easy cleaning of the area between the door and the door frame structure.

The coupling areas 28 of the adjustment block 26 may be used to vary the tension in the elastic element 22. If the tension in the elastic element is increased, the return force on the door will be likewise increased. Further, by doubling the elastic element 22 back around the pulley wheel back toward its connection at the door frame structure there will be more leeway in adjusting the tension of the elastic element 22. This doubling back of the elastic element 22 allows for a higher return force to be placed on the door 12 which enables a partially opened door (e.g. opened approximately one inch) to be forced shut. The configuration of the elastic element 22 passing through the grooved circumference 15 of the braking wheel 16 also adds frictional engagement for the elastic element with the braking wheel. Thus, even though the return force of the elastic element 22 is higher with a more highly tensioned element, there is still sufficient braking for the door 12 as it nears its closed position to slow it down so that it will close firmly but will not strike the door frame structure 14 with a great enough force to leave the door slightly ajar. However, even with this control, there is still a sufficiently high tension in the elastic element 22 to fully close a partially opened door.

In another preferred embodiment, a slanted sliding door is provided. To provide a greater frictional surface area of contact, the outer circumference 25 of the pulley wheel 16 is in frictional contact with an upper track in the door frame structure 14 and the elastic element 22 is crossed over itself before engaging with the grooved circumference 19 of the pulley wheel 20 and around the pulley wheel 20. When the slanted sliding door is moving to its closed position, the pulley wheel 20 rotates in a direction opposite to the movement of the door since the elastic element 22 is crossed over itself. This rotation of the pulley wheel 20 creates friction between the outer circumference 25 of the pulley wheel 20 and the door frame structure 12. The tension of the elastic element 22 is still sufficient to fully close the slanted door regardless of how far it is opened. Further, the tension and frictional characteristics of the elastic element 22 are sufficient to fully close the slanted door at a rate which will prevent slamming the slanted door against the door frame structure 14. Therefore, there preferably is always sufficient tension in the elastic element 22 to fully close the slanted door and leave it closed, even when the slanted door is pushed open only slightly. Moreover, the frictional engagement between the braking wheel 16 and that portion of the elastic element that comes in contact with it preferably increases as the slanted door moves to a closed position, while never reaching the point where the door is stopped by any such frictional engagement.

While a particular form of one aspect of the invention has been illustrated and described, it will be apparent that various modifications can be made without departing from the scope of the invention. For instance, the elastic element 22 may have a tapered outer diameter for further control of the acceleration and deceleration of the door as it closes. Thus, as the door reaches its closed position the position of the elastic element engaged to the braking wheel has an even larger increase in its outer diameter than would a non-tapered elastic element thereby further slowing the door as it reaches its closed position. Additionally, the grooved circumference of the braking wheel may be tapered or V-shaped to add further friction to the elastic element and further slow the door as it moves to its closed position and the elastic element may have the cross section of a V-belt. Also, the braking wheel 16 may be replaced with an orifice through which the elastic element 22 passes. Further, the elastic element may have a solid bulge or the like to quickly decelerate the door at a critical time as the door is closing or at a critical position, such as when the door approaches the frame, as the bulge would be wider than the orifice or other restriction. Accordingly, it is not intended that the invention be limited by the specific embodiment disclosed in the drawings and described in detail hereinabove.

The size and construction of the elastic element 22 for the self-return mechanism 10 will, in many instances, depend on the construction and weight of the closure, such as a sliding glass door. The heavier the door, the greater the force necessary to close the door, or to overcome the momentum of the door. Additionally, the more efficient the slider mechanism is, namely the running gear, the less is the force necessary to overcome the momentum of the door. If a particular door construction has too much frictional drag, a heavier elastic element is needed to adequately close the door. All other things being equal, the greater the force that is needed to be developed in the elastic element 22, the less flexibility there is in designing and configuring the self-return mechanism 10.

Figure 10:
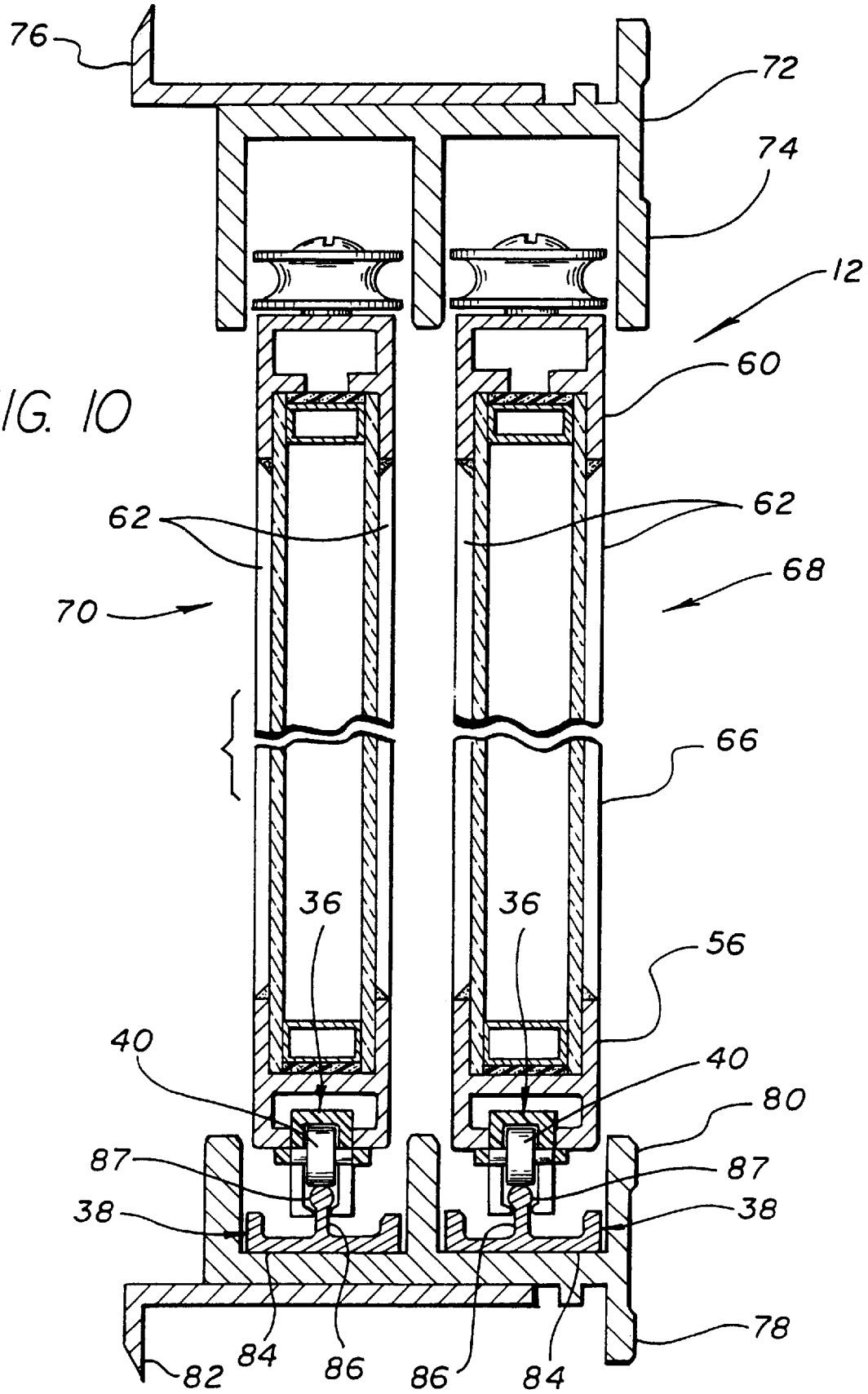
FIG. 10 is a transverse sectional view of a door and frame structure showing a wheel and track unit according to a further aspect of the present invention, which is suitable for a vertical or slanted door installation.

In order to provide a more efficient slider assembly with less frictional drag, a running gear has been provided which minimizes the frictional drag developed between the running gear and the stationary door frame, and which. provides better movement of a closure unit such as a sliding glass door or other structure. In a first preferred embodiment shown in FIGS. 10–14, a wheel unit 36 supports the sliding glass door unit 12 for movement on a track 38. The door construction shown in FIG. 10 is essentially the same for and is equally applicable to vertical as well as slanted doors, and the wheel units work equally as well with both. The wheel unit includes at least one and preferably a pair of longitudinally aligned wheels 40 each of which preferably has a flat circumferential bearing surface 42 for running on the track 38. The wheel unit further includes a housing 44 for supporting each of the pair of longitudinally aligned wheels and also for providing guides or guards for maintaining the running gear transversely or laterally aligned on the track 38, and in the embodiment shown in FIG. 10, for providing an indication or click when the housing and door are properly placed on the track, as described more fully below.

It is preferred, generally, to have the contour of the surface of the wheel which contacts the track be different than the contour of the contact surface of the track. Different contours for the contacting surfaces enhances the smooth running of the running gear on the track, limiting the frictional drag and prolonging the useful life of the running gear and the structure. By way of example, a track resting in a 1 inch wide groove in the frame may be dimensioned to move from side to side a distance of 0.062 inch. It is possible that greater or lesser movement may be permitted, but a range of about 0.062 inch is suitable.

Each wheel 40 is preferably supported through a bearing assembly 46 (FIG. 14) around an axle 48 (FIGS. 12 and 14) mounted in the housing 44. The wheel is preferably wide enough to reliably ride on the track 38 without risk of derailing. In the embodiment of FIG. 10, the width of each wheel is slightly less than the spacing between opposing walls of the housing.

The housing includes side walls 50 for protecting the wheels from side impact and also for supporting guides or guards which maintain the wheels transversely aligned on the rails. The housing includes at least one pair of bumps, protrusions or beads 52 spaced apart and positioned opposite each other on opposite sides of the housing at approximately the bottom edge 54 of the housing. Each bump extends inwardly toward the vertical center of the housing to assist in aligning the wheel unit, and therefore the door, on the track 38. In the preferred embodiment, if the housing is precisely centered on the track, the bumps 52 do not contact the rail. Alternatively, a plurality of pairs of bumps 52 can be positioned at appropriate points longitudinally along the inside walls of the housing 44. However, a minimum number of bumps are preferred so as to minimize the frictional drag which may be created when a particular bump contacts the track. The housing and bumps are preferably formed from acetal, a material considered to have self-lubricating properties. Acetal would minimize the frictional drag which may occur when a bump contacts the track.

In one preferred embodiment, the bumps 52 run the entire length of the center part of the housing and are spaced apart from one another sufficiently to still allow some tolerance when the housing is placed on the track. Therefore, there will be certain positions for the wheel unit on the track where neither of the bumps 52 contact the rail. In another preferred embodiment, the bumps 52 are hemispherical.

Use of a flat wheel surface minimizes the frictional contact between the wheel and the rail, thereby minimizing the linear frictional contact as well as the rotational frictional contact which may occur between the wheel and the track. The guidance originally provided by the sides of conventional grooved wheels is replaced by the minimal point contact between a given bump 52 and the track. Therefore, the side or lateral frictional component of contact between the moving door and the stationary track is minimized.

The wheel assembly is preferably mounted recessed in a bottom slider door rail 56 by means of a mounting flange 58 situated around the outside of the housing 44 at approximately the level of the center axis of the wheels 40.

In a preferred embodiment designed to accommodate a door weight of up to 100 pounds, the wheel diameter is preferably 0.620 inch with a 0.025 inch spacing between the top of the wheel and the bottom of the top housing wall. The distance from the bottom of the wheel to the bottom edge 54 of the housing is preferably approximately 0.100 inch so that the bottom edge of the housing extends below the wheel to serve as a guide. The wheel width is preferably 0.210 inch and the inside width of the housing is preferably 0.236 inch. The center-to-center distance between adjacent wheels is preferably 0.785 inch. The distance from the top of the mounting flange 58 to the bottom edge 54 of the housing is approximately 0.473 inch and the distance from the top of the housing to the bottom edge 54 of the housing is approximately 0.785 inch.

Each slider door preferably includes two wheel units, each at the approximate end of the door. Each door (FIG. 10) is made up of the bottom slider door rail 56, a top door rail 60 and side door rails 62. The slider door rails surround and protect a glass unit 66. The front door unit 68 and the rear door unit 70 are mounted in a surrounding frame similar to the frame 14 of FIG. 1 defining an opening to an enclosure such as a cooler or refrigerator, including a top frame 72 having a facing 74 and back trim 76 and a bottom frame 78 having a bottom facing 80 and bottom back trim 82, all for mounting the doors in the opening. Each top frame has sufficient head space to allow the door to be lifted into and out of its respective track. The frame is preferably formed from a suitable polymer such as extruded PVC.

The bottom frame 78 includes tracks 38 corresponding to and supporting the doors 68 and 70. Each track is preferably formed from a suitable metal, such as extruded aluminum, and placed in the bottom of the frame. Each track preferably includes a flat base 84 extending slightly less than the length and width of the bottom of the frame corresponding to each door so that each rail is self-aligning relative to its respective door and independent of the frame 78. The track also includes an upstanding rail 86 for supporting the wheels 40, and thereby the doors or other closures. In the embodiment shown in FIG. 10, the top of each rail includes a bead 87 having a rounded top for minimizing the surface area of contact between the rail and the corresponding wheel or wheels. Preferably, the area of contact for a given wheel with the top of each rail 86 is as narrow and as short a line as possible to minimize frictional drag.

During the normal life of the frame, the shape or cross-sectional configuration of each groove or slot in the frame may change slightly due to cold flowing. Because the track 38 is smaller than, and rests freely in, the groove, the track is self-aligning under the wheel units and does not move appreciably with the frame. Furthermore, a surrounding frame may be improperly installed, may be subject to twisting or other deforming forces so as to go somewhat out of alignment. Where the frame changes from its originally straight configuration, the track 38 may still maintain its original alignment relative to the door to permit easy and smooth running of the door over the track. Furthermore, where the surrounding frame changes shape upon installation due to faulty installation or due to a poorly formed opening, the track can still stay aligned, straight and level relative to the door to maintain easy and smooth running of the door. Therefore, a free, relatively unconfined track enhances the operation of the door and prolongs the life of the door or other structure.

Each wheel unit includes at least one wheel assembly 88 (FIG. 14) and preferably includes two wheel assemblies 88 which snap into openings 90 (FIG. 11) defined by respective walls in the housing extending more than 180°. Preferably, the walls defining the openings 90 in the housing for accepting the wheel assemblies extend 240°. The shortest distance between the two sides of the opening is approximately 0.115 inches so that each wheel assembly clicks into place and is retained in the opening during normal operation.

Each wheel assembly 88 (FIG. 14) includes a tire 92 supported by a plurality of bearings 94 in the bearing assembly 46, which in turn are supported by a unitary and combined bearing race and spindle 96 forming the axle 48. The tire includes a circumferential interior groove 98 extending around the inside of the tire to assist in retaining the bearings 94 as the tire rotates around the spindle combination 96. An inwardly extending flange 100 on the tire forms a closed side of the wheel assembly. The bearing race and spindle combination 96 include a bearing race 102 having a groove 104 for supporting the bearings 94 as they rotate about the spindle combination 96. The outer diameter of the race is preferably 0.231 inches and the diameter to the bottom of the groove 104 is 0.200 inches. A shaft 106 extends outwardly from each side of the bearing race 102 to serve as an axle and to serve as a mounting point for the wheel assembly in the openings 90 of the housing 44. The shaft diameter is approximately 0.128 inches. The tire is preferably formed from acetal or another suitable material. The bearings 94 are preferably stainless steel and the spindle combination 96 is preferably a softer metal.

Figure 14:
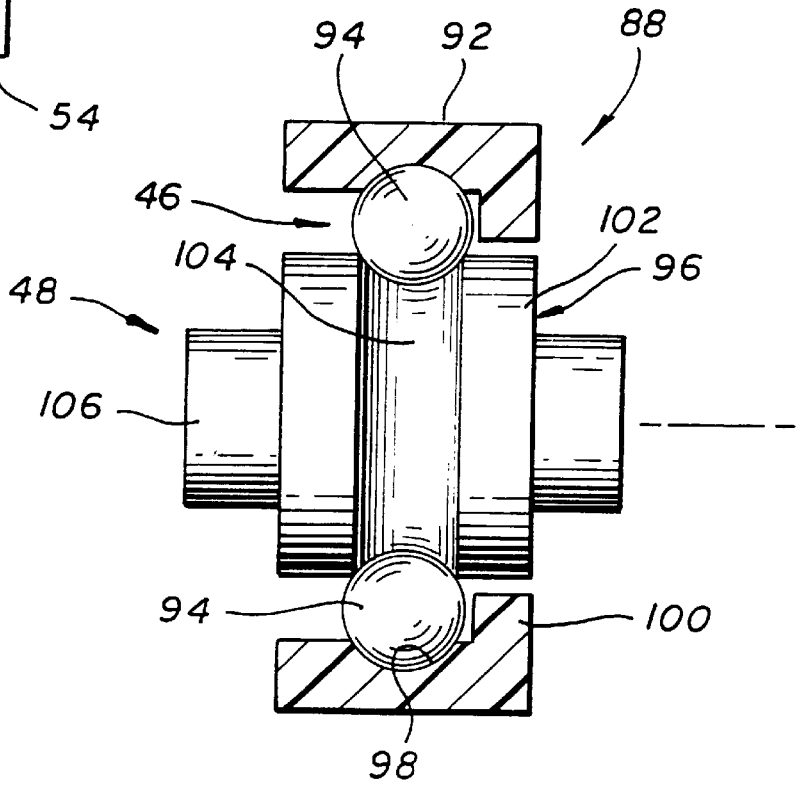
FIG. 14 is a transverse cross-sectional view of a wheel and bearing unit for use in the wheel unit of FIG. 10.

The thickness of the tire 92 on the left side of FIG. 14 is preferably 0.090 inches to provide a suitable amount of material (e.g. 0.080 inches) between the bottom of the bearing groove 98 and the outer tread of the tire 92. This thickness provides a long life wheel assembly which is only minimally affected by possible cold flowing as the wheel unit and door assembly rest on the track 38.

By reducing the size of the wheel assembly, such as by reducing the tire thickness, and combining the inner bearing race and spindle, the wheel assembly can be made as small as possible, thereby increasing the open viewing area of the remainder of the door. The vertical profile of the wheel unit is minimized, while still providing a reliable wheel unit, to provide a relatively larger viewing area for the door or other structure and to minimize the total vertical door height taken up by the wheel unit.

With the smaller, recessed running gear for the sliding glass door, and with a suitable rail height for the track 38, the sliding glass door can be positioned within the surrounding frame so that the door rails appear symmetrical within the surrounding door frame. As can be generally seen in FIG. 1, the amount of each door rail exposed to view inside the surrounding frame is approximately the same for each rail. Additionally, the door dimensions are such that the running gear are hidden. There is still sufficient clearance at the top of the door for the door to be raised within the opening and inserted or removed from the surrounding frame. In a slanted door configuration, such as if the doors and frame of FIG. 10 were slanted, the surrounding frame can still guide the sliding glass doors as necessary.

As an alternative to increasing the tire thickness to minimize the effect of cold flowing in the tire, the enlarged bead 87 on the rail 86 may be flattened slightly to increase the surface area of contact between the wheel and the rail. However, doing so somewhat sacrifices smooth operation by producing more frictional drag between the wheel and the rail. Conversely, by decreasing the radius of curvature of the bead 87 on the rail 86, the surface area of frictional contact between the rail and the wheel is minimized. However, the tendency of cold flowing in the tire increases. Nonetheless, various solutions exist to counteract such possibility of cold flowing. For example, the wheel unit may be designed with brass wheels to run on a stainless steel track to improve the efficiency of the unit. Additionally, the bead 87 may be formed to have a triangular cross-section with stainless steel to support a brass wheel, in which case the surface area of contact between the rail and the wheel is kept at a minimum.

The snap-in and snap-out wheel assembly provides a number of benefits. Primarily, a snap-in wheel unit permits easy repair of door assemblies in the case of an unexpected failure of the wheel unit. While the wheel housings may be removably fastened to the bottom rail of a door structure, it may be easier to replace the wheel assemblies rather than the entire wheel unit simply by snapping in a new wheel assembly. Replaceable wheel units also prolong the life of the door, which constitutes the major cost of the door structure. Having a snap-in wheel assembly also permits standardization of parts and the like. Moreover, National Sanitation Federation (NSF) standards require that parts in a food zone be easily removable without the use of tools, for example for cleaning purposes, and a removable wheel assembly contributes to the ease with which the running gear can be cleaned.

Figure 15:
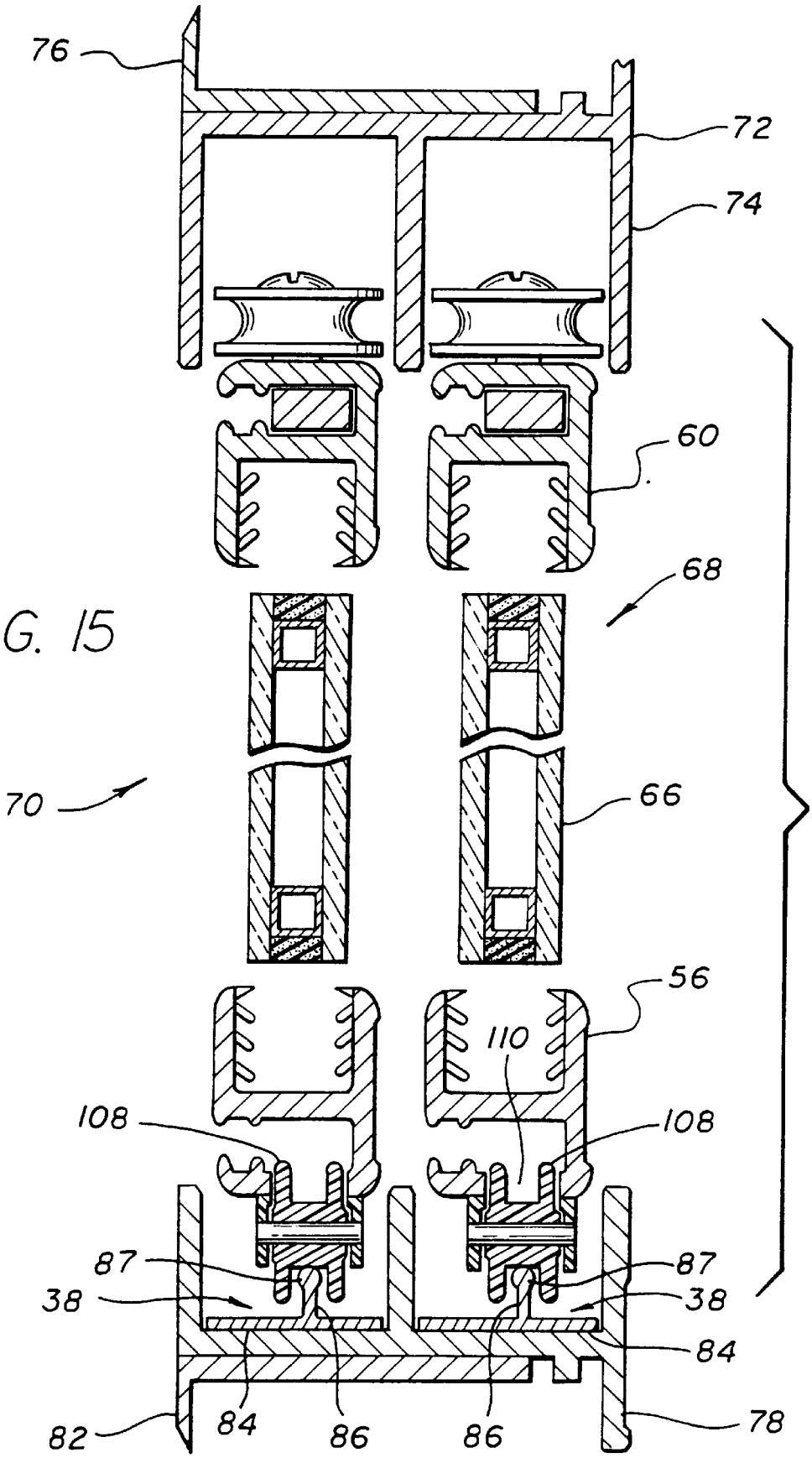
FIG. 15 is a vertical transverse section of a door and frame unit similar to FIG. 10 showing an alternative wheel unit according to a further aspect of the present invention.

FIG. 15 shows an alternative form of a wheel unit according to a further aspect of the present invention. Each wheel unit is supported by a track such as that described above with respect to FIG. 10 having a bead 87 with a round profile. Each wheel unit includes one or more wheels 108 having a square profile 110 for running on the rail 86. The square profile minimizes the surface area of contact between the wheel and the rail 86 for vertical support of the door, while also reducing the surface area of contact for lateral or sideways support or alignment of the door as the door moves along the rail 86. As with the wheel unit of FIG. 10, the vertical support function and the lateral guidance function of the wheel unit is separated into two structures to reduce the frictional drag created between the wheel unit and the rail 86.

Figure 11:
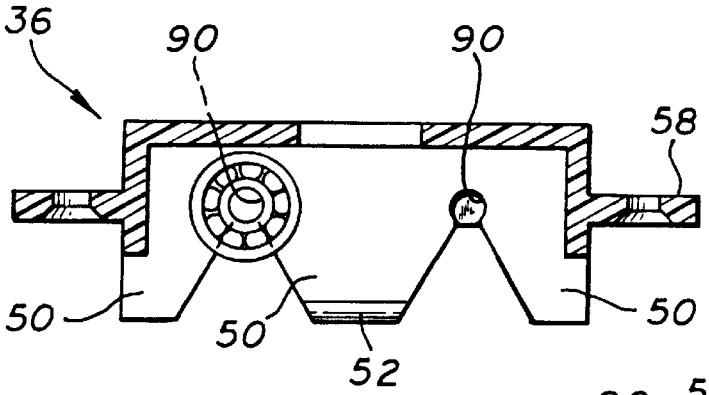
FIG. 11 is a longitudinal cross-sectional view of the wheel unit housing of FIG. 10.
Figure 13:
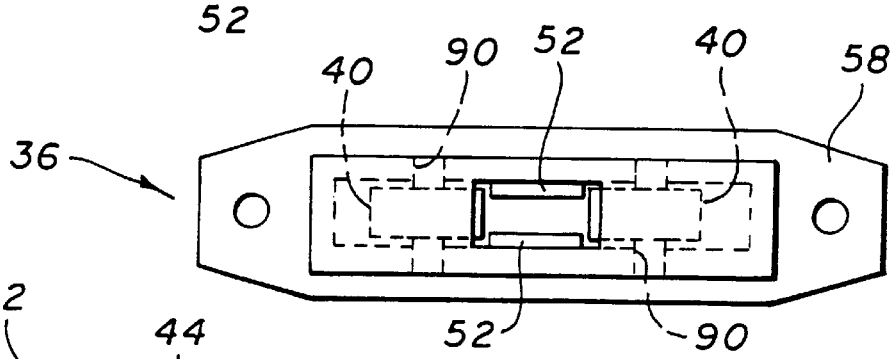
FIG. 13 is a top plan view of the housing of FIG. 11.
Figure 12:
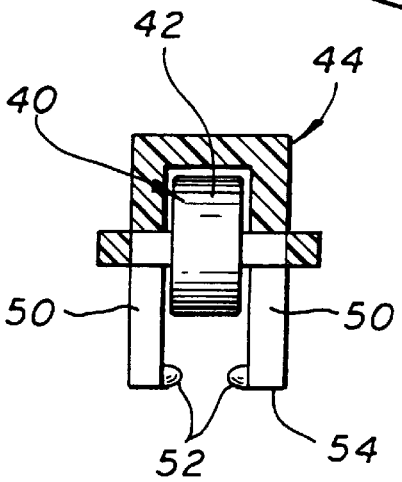
FIG. 12 is a vertical transverse section of the wheel unit of FIG. 10.

The wheel housing may take a number of different configurations, such as having several pairs of oppositely facing bumps at different locations in the housing. The location of the bumps 52 centered in the housing 44, as shown in FIG. 11, is preferred because the bumps are centered between the two wheel assemblies in the housing and therefore do not affect the movement of one wheel relative to the other. While bumps may be placed at the ends of the housing also, contact of one bump at the end of a housing with a poorly aligned track segment may affect movement of the wheel at the other end of the housing, thereby producing additional frictional drag. As a result, the lateral position of one wheel may affect the movement of the other wheel in the housing. It should be noted that poor track alignment affects operation of convention wheel units wherein grooved wheels conform to the profile of the track, for example where two closely aligned wheels travel over the track. A bend or curve in the track causes the forward grooved wheel to follow the bend in the track while the rearward grooved wheel tries to stay in alignment with its portion of the track. The opposing forces cause the grooved wheels to produce frictional drag and possible binding between the wheels and the track since the curved wheels contact significant portion of the profile of the track. Such wear reduces the effective life of the running gear.

While it is preferred that the spacing between opposed bumps is less than the width of the wheel and also less than the diameter of the rail bead 87, thereby allowing the housing to click over the bead on the rail, the spacing between pairs of bumps may be greater than the rail bead diameter and still provide the lateral guidance function. Additionally, the bumps may even be omitted in favor of lateral guidance being provided by preferably short sides of the housing. However, the sides of the housing would provide greater frictional contact between the housing and the rail than would occur if a smaller pair of bumps were provided on the housing for lateral guidance.

As a further alternative, the wheel housing could be self aligning in the door rail by placing the wheel unit in an oversized cavity in the door rail and held in place by shoulder screws allowing the unit to float in three mutually perpendicular directions in the door rail. This would accommodate a track which may have been damaged during shipment so that the track is no longer perfectly straight. The wheel housing would then float in the door rail to follow the track.

By separating the vertical support function of the wheel from the lateral guidance function provided by the wheel housing, other configurations for the wheel unit are foreseeable. For example, a pair of parallel rails and flat wheels may provide the vertical support function for the door or other structure while the lateral guidance function is provided by a flange centered between the pair of wheels with bumps or protrusions facing away from each other and toward respective rails. Additionally, it is preferred but not essential that each wheel unit have a pair of wheel assemblies. Alternatively, each wheel unit may be formed from a single wheel assembly. For example, the square profile wheel arrangements shown in FIG. 15 may be best used where each wheel unit is formed from a single square profile wheel, one wheel unit being located at each end of the door rail. Alternatively, the wheel units shown in FIGS. 10–13 may accommodate four or even six wheel assemblies and still not create unacceptable frictional drag. It should also be understood that the wheel assemblies do not need to be configured in pairs, but such is preferable.

Figure 16:
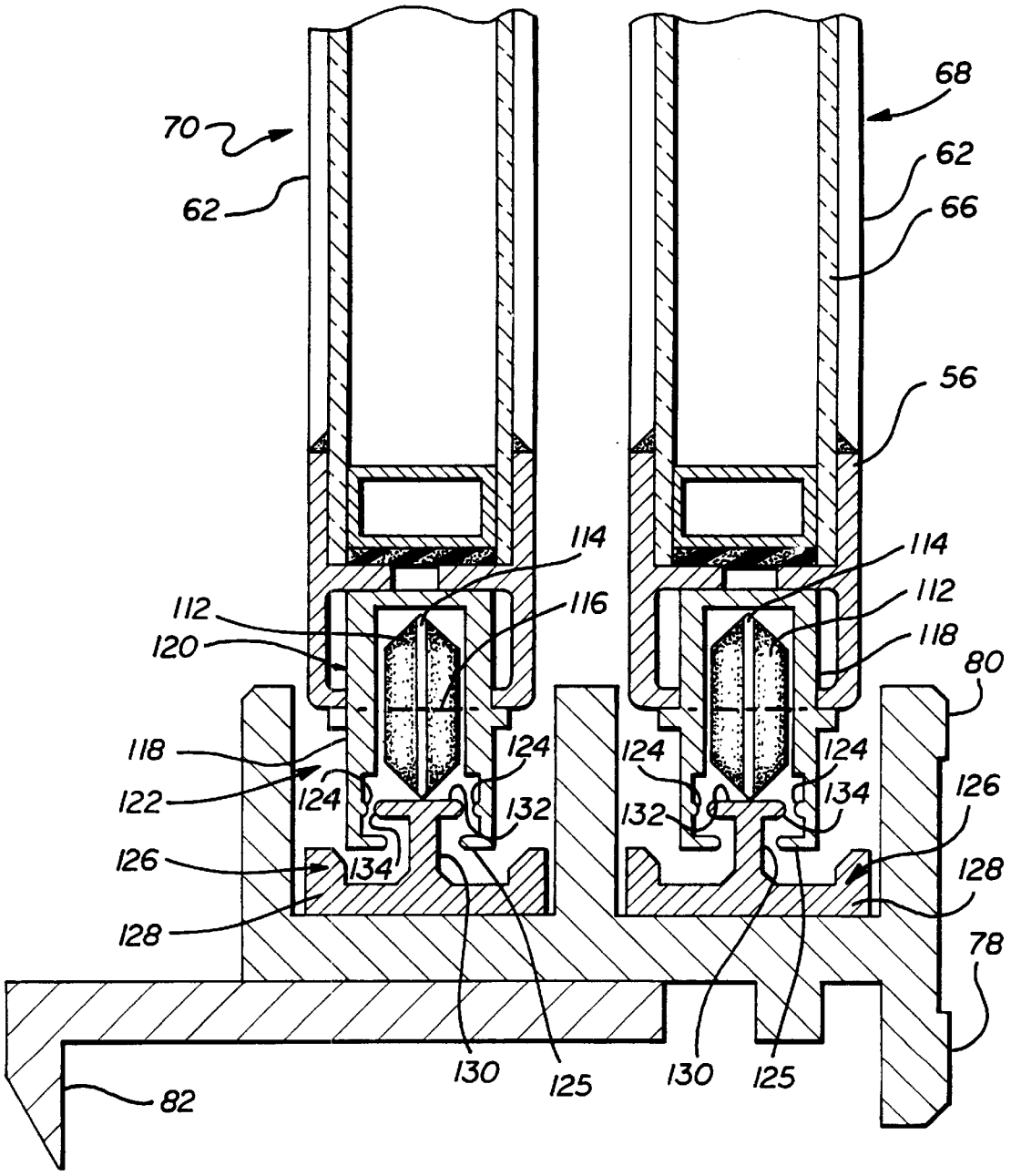
FIG. 16 is a vertical transverse section of a door and frame unit similar to FIG. 10 showing an alternative wheel and track unit according to another aspect of the present invention.
Figure 17:
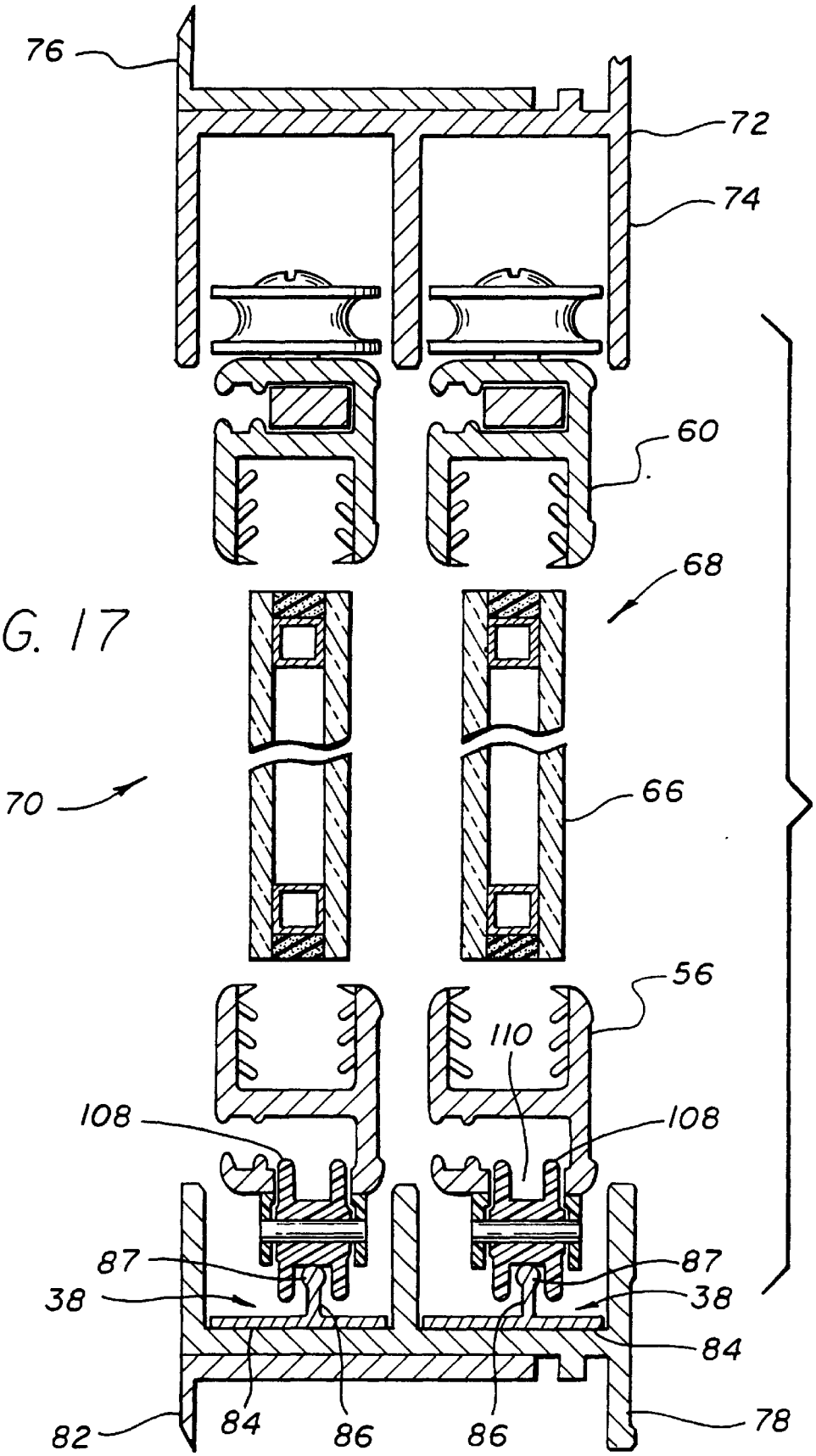
FIG. 17 is a vertical transverse section of a door and frame unit similar to FIG. 15 showing a wheel unit, door and frame unit alternative to that of FIG. 15.

Preferably, the contour of the surface of the wheel which contacts the contour of the surface of the track is different from that of the track. For example, the contour of the wheel bearing surface is flat in the configuration shown in FIGS. 10 and 15 and the contour of the contact surface of the track is round, at the bead 87. Other configurations are possible, such as where the wheel has a triangular or V-shaped cross section and the wheel bearing surface for contact with the track is pointed, on the one hand, and the track is flat (FIG. 16). Additionally, the contour of the contact surfaces on those portions of the wheels of FIG. 15 which provide lateral guidance or support are also flat whereas the contour of the corresponding contact surface on the track is round. Also, the contour of the bumps or beads 52 on the housing for lateral guidance (FIG. 10) are preferably rounded (in vertical transverse section) whereas the contour of the corresponding contact surface on the track is flat. Alternatively, the bumps 52 may be positioned so as to contact the under side of the bead on the track, such that the contours of the surfaces of contact are oppositely rounded, in other words are curved in opposite directions. Having the contours of the contacting surfaces different minimizes the surface area of contact between the two, thereby limiting the frictional drag created between the two. Configurations where the contours are the same, such as a round grooved wheel on a conforming round topped track, have increased surface area of contact between the moving surfaces in order to maintain alignment, thereby developing a relatively large amount of frictional drag. By providing contact surfaces of different contours, the frictional drag is minimized.

The V-shaped or triangular wheel 112 (FIG. 16) contour is preferably formed with a slight radius 114 to minimize premature wear on the wheel. (As with FIGS. 10 and 15, the door construction of FIG. 16 can be installed in a vertical or a slanted opening.) The wheel 112 is supported on a shaft, shown schematically at 116, with bearings in a manner similar to that shown in FIGS. 10–15. The shaft is supported in a similar manner by a housing 118 having an upper portion 120 similar to the upper portion of the housings shown in FIGS. 10–15. The lower outside walls 122 of the housing preferably extend below the lower edge of the wheel. The housing also preferably includes a center part or other housing part with guides. The guides 124, in the embodiment shown in FIG. 16, are preferably formed on the center part of the housing, on the inside surfaces thereof, and extend toward each other for contacting the track and maintaining the wheel unit and the door aligned. The door and the glass panels in FIG. 16 are similar to those shown in FIGS. 10 and 15 and are identified with corresponding reference numerals. The guide 124 preferably extends substantially the same longitudinal length on the housing as the guides in FIGS. 10 and 15. Alternatively, the guides 124 may be hemispherical, to further minimize the contact area; or the guides may be omitted, for example in favor of the round-tipped flange elements described below. The center part of the housing extends downwardly to facing flange elements 125 for providing an indication or click as the door is being properly placed on the track. The flange elements may extend the length of the bottom of the center part of the housing. The track 126 includes a base 128 and a rail 130 having a contact portion or top 132 having a flat or straight contour to support the wheel 112. The rail also includes convex, in transverse section as seen in FIG. 16, sides 134 positioned at the same height as the guides 124 for contacting the guides and maintaining the position of the door on the track as the door moves. The respective contours of the guides 124 and of the sides 134 of the track are different since they are curved in opposite directions and have a minimum surface area of contact.

An example of possible door and running gear dimensions will demonstrate the flexibility in operation and the amount of floating or lateral movement which can be permitted with the disclosed invention. By way of example, assuming that the width of the rail top 132 is 1 inch, and the vertical portion of the rail has a thickness of ⅛ inch, resting in a frame slot or groove having an inside width of 2 9/16 inches, the outside width of the housing for that portion below the flange, namely the lower outside walls 122 is 1⅞ inches. Where the upper portion of the housing is smaller, the lower outside walls 122 are outboard of and extend downwardly from the upper portion, connected by a suitable web. The flange elements 125 may extend inwardly to a point 3/8 inch away from the vertical portion of the rail so that the convex rounded edges of the flange elements 125 extend approximately 1/16 inch underneath the corresponding rail top 132. The rail top and flange elements 125 are preferably spaced vertically away from each other approximately 1/16 inch. The spacing between the outside wall of the lower portion of the housing and the adjacent frame wall may be approximately 11/32 inch. The thickness or height of the protrusion or bump 124 may be 3/32 inch so that the distance between the end of the protrusion 124 and the adjacent end 134 of the rail top is slightly less than 3/8 inch. Such configuration would permit a total range of movement or floating of the housing relative to the rail of approximately 9/16 inch, or 9/32 inch in each direction from the center of the rail. Therefore, such a configuration would allow movement of the housing and the wheel unit approximately half of the total width of the rail top, namely 9/16 inch of movement relative to 1 inch of rail top surface. Scaling these dimensions down to accommodate a smaller rail top or smaller groove width in which the track is dropped still permits a total range of movement of the door of approximately half the total rail top width.

The exemplary wheel and track configuration shown in FIG. 16 having a V- or triangular-shaped wheel with a flat track can be a suitable alternative to the contours shown in FIGS. 10 and 15. Should the triangular wheel wear or change shape due to cold flowing, the result is simply a wheel with a somewhat wider point or contour but one which would still have a relatively small area of contact between the wheel and the track and one which is still self-aligning.

It is to be understood that the embodiments of the invention disclosed herein are illustrative of the principles of the invention and that other modifications may be employed which are still within the scope of the invention. Accordingly, the present invention is not limited to those embodiments precisely shown and described in the specification but only by the following claims.

We claim:

1. A wheel unit for supporting a structure for movement on a track having a non-flat supporting surface, the unit comprising:

at least one rotatable wheel having a substantially flat bearing surface and supported on an axis for running on a track; and a housing for supporting the wheel, including a convex-shaped guide for maintaining the wheel on the track.

2. The wheel unit of claim 1 wherein the rotatable wheel includes sides extending radially no further than the substantially flat bearing surface.

3. The wheel unit of claim 1 wherein the rotatable wheel includes a shaft and a bearing for supporting the wheel on the shaft.

4. The wheel unit of claim 1 wherein the unit includes an even number of rotatable wheels and wherein the housing supports the wheels.

5. The wheel unit of claim 4 wherein the guide is located intermediate the wheels so that an equal number of wheels are positioned in the housing on one side of the guide as are positioned on the other side of the guide in the housing.

6. The wheel unit of claim 5 wherein the wheel unit includes two rotatable wheels supported in the housing and wherein the housing includes a center part positioned longitudinally between the two wheels and wherein the center part includes the guide for maintaining the wheels on the track.

7. The wheel unit of claim 6 wherein the center part of the housing extends along respective planes outside of the sides of the wheels, wherein the wheels extend downwardly in the housing to a lower-most point and wherein the center part of the housing extends below the lower-most point of the wheels, and wherein the guide includes at least one protrusion extending inwardly toward a line defined by the longitudinally aligned wheels.

8. The wheel unit of claim 7 wherein the guide includes a pair of oppositely facing protrusions on the center part of the housing.

9. The wheel unit of claim 8 wherein the distance between the spaced-apart protrusions is less than the width of the wheels.

10. The wheel unit of claim 1 wherein the wheel includes a shaft and the housing includes a wall defining a support for the wheel shaft wherein the wall includes an opening having a dimension smaller than a dimension of the shaft so that the shaft can be removably inserted through the opening into the shaft support.

11. The wheel unit of claim 1 wherein the guide and the housing for maintaining the wheel on the track includes a protrusion extending longitudinally of the housing.

12. The wheel unit of claim 1 further including a mounting element in the housing for mounting the wheel unit to a structure wherein the mounting element is positioned approximately intermediate the housing between an upper portion of the housing and a lower portion of the housing.

13. The wheel unit of claim 1 wherein the wheel is formed from a plastic.

14. The wheel unit of claim 13 wherein the wheel is formed from acetal.

15. A wheel and track unit for supporting a structure for movement on a track, the unit comprising:

a wheel having a substantially flat bearing surface and supported on an axis for running on a track;

a housing for supporting the wheel, including a convex-shaped guide separate from the wheel for maintaining the wheel on the track; and a track having a non-flat supporting surface for supporting the unit through contact with the substantially flat bearing surface of the wheel.

16. The wheel and track unit of claim 15 wherein the housing includes sidewalls extending a distance greater than a diameter of the wheel and wherein the guide for maintaining the wheel on the track is spaced apart from the wheel.

17. The wheel and track unit of claim 16 wherein the guide includes a plurality of protrusions on the sidewalls of the housing spaced apart by a first distance, wherein the track includes a rail having a second dimension defining a width of a rail wherein the second dimension is greater than the first dimension of the guide so that the guide fits over the rail with an interference fit.

18. The wheel and track unit of cliam of 15 wherein said supporting surface of the track includes a bead on top of the rail.

19. The wheel and track unit of claim 18 wherein the bead has a substantially round profile.

20. A wheel and track unit for supporting a structure for movement on a track, the unit comprising:

a wheel supported on an axis;

a housing for supporting the wheel, including a convex-shaped protruding guide separate from the wheel for maintaining the wheel on a track; and a track for supporting the wheel and housing through contact with the wheel.

21. A closure unit comprising:

a track;

a panel;

a wheel unit for supporting the panel on the track wherein the wheel unit includes at least one rotatable wheel having a substantially flat bearing surface and supported on an axis for running on the track; and a housing for supporting the wheel, including a convex-shaped guide for maintaining the wheel on the track.

22. The closure of claim 21 wherein the housing is at least partly recessed in the bottom of the panel.

23. The closure of claim 22 wherein the housing further includes a mounting element between the top and bottom of the housing for mounting the housing at least partly recessed in the panel.

24. The closure of claim 23 wherein the mounting element includes a flange extending around the outside of the housing approximately intermediate between the top and bottom of the housing.

25. The closure of claim 21 wherein the housing is movable relative to the panel, so that the wheel unit is at least partially self-aligning on the track.

26. The closure of claim 25 wherein the panel includes a wall defining an opening for the housing having a first cross-sectional area, wherein the housing fits into the opening in the panel and has a second cross-sectional area for the housing portion which fits in the opening in the panel and wherein the second cross-sectional area is less than the first cross-sectional area.

27. The closure of claim 26 wherein the housing includes a rectangular housing and wherein the opening in the panel is substantially rectangular and wherein the width and length of the housing is less than the corresponding width and length of the opening in the panel.

28. The closure of claim 21 wherein the housing is mounted to the panel through removable fasteners.

29. The closure of claim 21 wherein the rotatable wheel includes sides extending radially no further than the substantially flat bearing surface.

30. The closure of claim 21 wherein the rotatable wheel includes a shaft and a bearing for supporting the wheel on the shaft.

31. The closure of claim 21 wherein the wheel unit includes two rotatable wheels supported in the housing, wherein the housing includes a center part positioned, longitudinally, between the two wheels, wherein the center part includes the guide for maintaining the wheels on the track, and wherein the guide includes a pair of oppositely facing protrusions on the center part of the housing.

32. The closure of claim 21 wherein the wheel unit includes a shaft and the housing includes a wall defining a support for the wheel shaft wherein the wall includes an opening having a dimension smaller than a dimension of the shaft so that the shaft can be removably inserted through the opening into the shaft support through an interference fit.

33. The closure of claim 21 further including a mounting element on the housing for mounting the wheel unit to a structure wherein the mounting element is positioned approximately intermediate the housing between an upper portion of the housing and a lower portion of the housing.

34. A closure unit comprising:

a track having a non-flat supporting surface;

a panel;

a wheel unit supporting the panel on the track wherein the wheel unit includes at least one rotatable wheel having a substantially flat bearing surface for supporting the weight of the panel and supported on an axis for running on the track and wherein the rotatable wheel includes substantially straight internal side walls for laterally guiding the wheel unit on the track; and a housing for supporting the wheel.

35. The closure of claim 34 further comprising a surrounding frame and wherein the track is movable within the surrounding frame.

36. A wheel and track unit for supporting and guiding a structure for movement on a track, the unit comprising:

a housing having a guide;

a wheel having a contact surface having a first dimension, and supported by the housing to rotate about an axis; and a track for supporting the housing and wheel and including a contact surface for contacting the contact surface of the wheel and wherein the contact surface of the track has a second dimension larger than the first dimension of the contact surface on the wheel and wherein the guide keeps the wheel on the track while permitting the wheel to move laterally on the track.

37. The unit of claim 36 wherein the wheel includes sides converging to the contact surface of the wheel.

38. The unit of claim 36 wherein the guide includes protrusions extending inwardly toward the track.

39. The unit of claim 38 wherein the protrusions are convex in transverse cross section.

40. The unit of claim 38 wherein the protrusions extend longitudinally of the housing.

41. The unit of claim 38 wherein the protrusions are hemispherical.

42. The unit of claim 38 wherein the track includes a flat-topped contact surface with rounded sides and wherein the rounded sides of the contact surface are at the same horizontal level as the guides on the housing.

43. The unit of claim 36 wherein the housing further includes a surface for contacting the track as the wheel is placed on the track to indicate when the wheel is properly placed on the track.

* * * * *